US007800026B2

(12) United States Patent
Lee et al.

(10) Patent No.: US 7,800,026 B2
(45) Date of Patent: Sep. 21, 2010

(54) HEATING BODY

(75) Inventors: Young Jun Lee, Seoul (KR); Yang Kyeong Kim, Boocheon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/457,254

(22) Filed: Jul. 13, 2006

(65) Prior Publication Data

US 2007/0012681 A1 Jan. 18, 2007

(30) Foreign Application Priority Data

Jul. 14, 2005 (KR) ..... 10-2005-0063715

(51) Int. Cl.
*H05B 1/02* (2006.01)

(52) U.S. Cl. ..... 219/494; 219/505; 219/511; 219/483; 219/547; 219/552; 338/22 R

(58) Field of Classification Search ..... 219/505, 219/212, 494, 504, 511, 483–486, 463.1, 219/537–539, 544, 552, 553; 338/22 R
See application file for complete search history.

(56) References Cited

U.S. PATENT DOCUMENTS

| | | | | |
|---|---|---|---|---|
| 2,581,212 | A * | 1/1952 | Spooner, Jr. et. al. | 219/212 |
| 3,731,058 | A * | 5/1973 | Bleiweiss | 219/523 |
| 4,309,597 | A * | 1/1982 | Crowley | 219/549 |
| 4,607,154 | A * | 8/1986 | Mills | 219/505 |
| 5,081,341 | A * | 1/1992 | Rowe | 219/505 |
| 6,035,101 | A * | 3/2000 | Sajoto et al. | 392/416 |
| 6,204,486 | B1 * | 3/2001 | Masaki et al. | 219/444.1 |
| RE40,181 | E * | 3/2008 | Scherzer et al. | 392/407 |

FOREIGN PATENT DOCUMENTS

| | | |
|---|---|---|
| BE | 397595 | 7/1933 |
| FR | 2686211 | 7/1993 |

OTHER PUBLICATIONS

U.S. Appl. No. 11/457,274 to Lee et al., filed Jul. 13, 2006.
U.S. Appl. No. 11/457,296 to Lee et al., filed Jul. 13, 2006.
English language Abstract of FR 2686211, Jul. 16, 1993.

* cited by examiner

*Primary Examiner*—Mark H Paschall
(74) *Attorney, Agent, or Firm*—McKenna Long & Aldridge LLP

(57) ABSTRACT

A heating body is provided. The heating body includes a plurality of heating members having different thermal expansion coefficients and a tube in which the heating members are disposed. At least one of the plurality of heating members supports other heating member.

19 Claims, 9 Drawing Sheets

【 Figure 1】
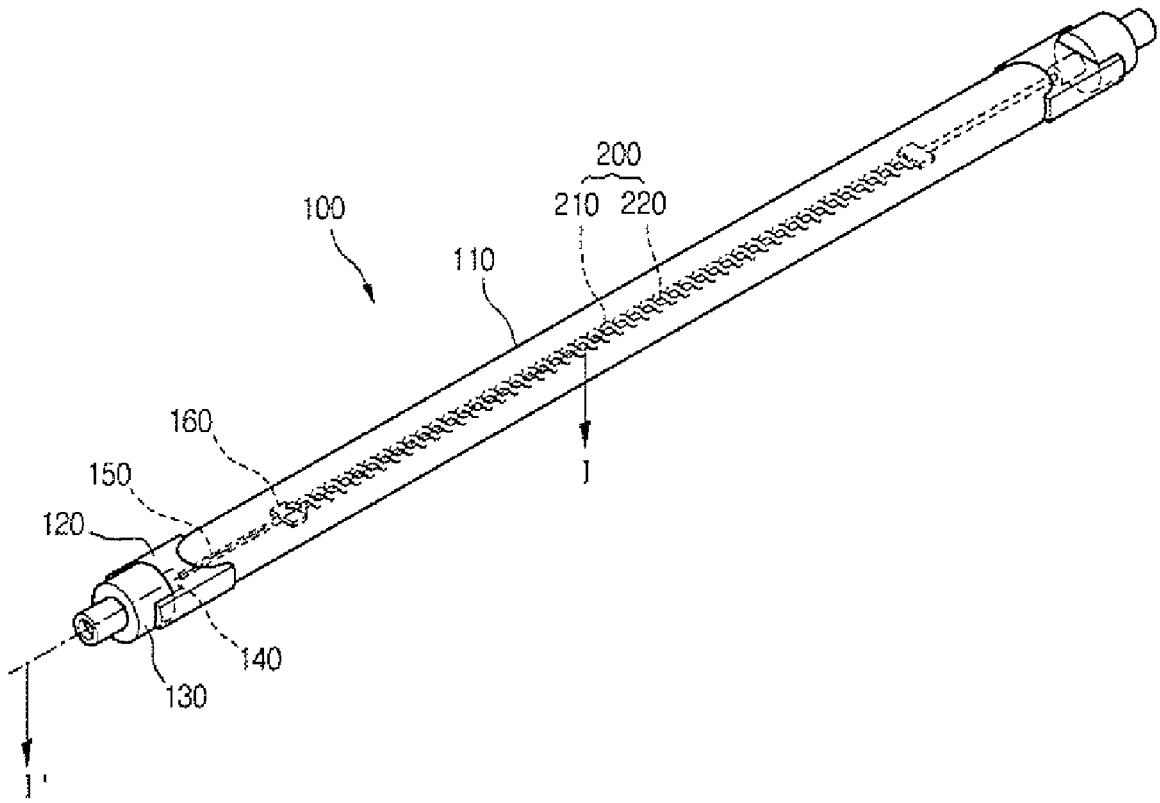

【 Figure 2】
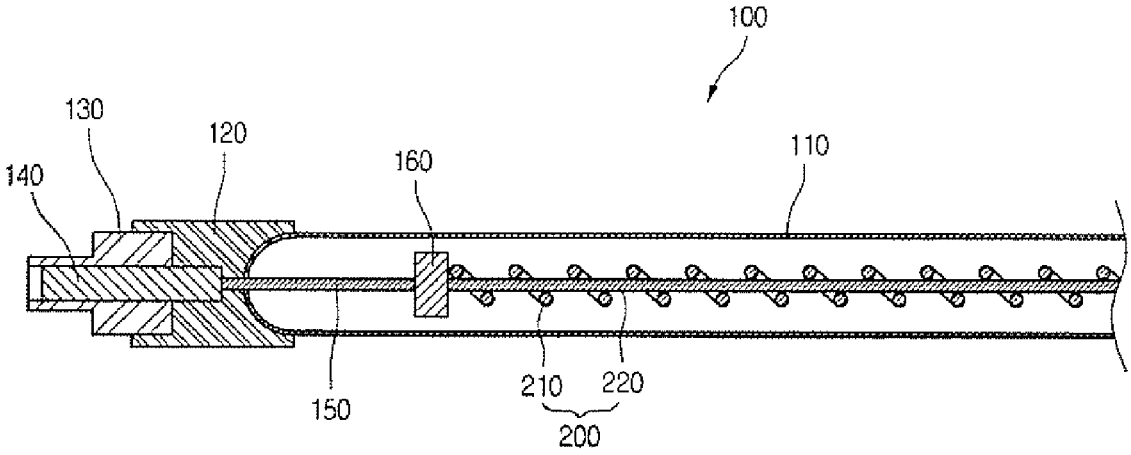

【 Figure 3】
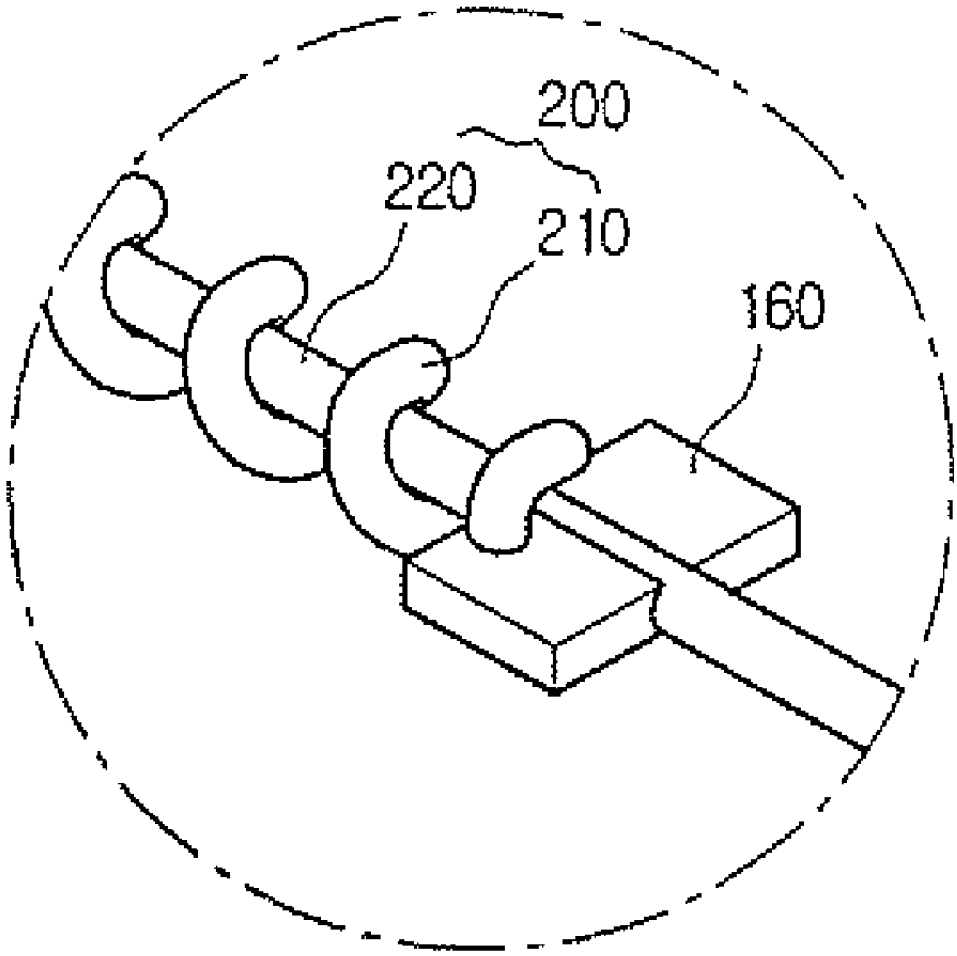

【 Figure 4】
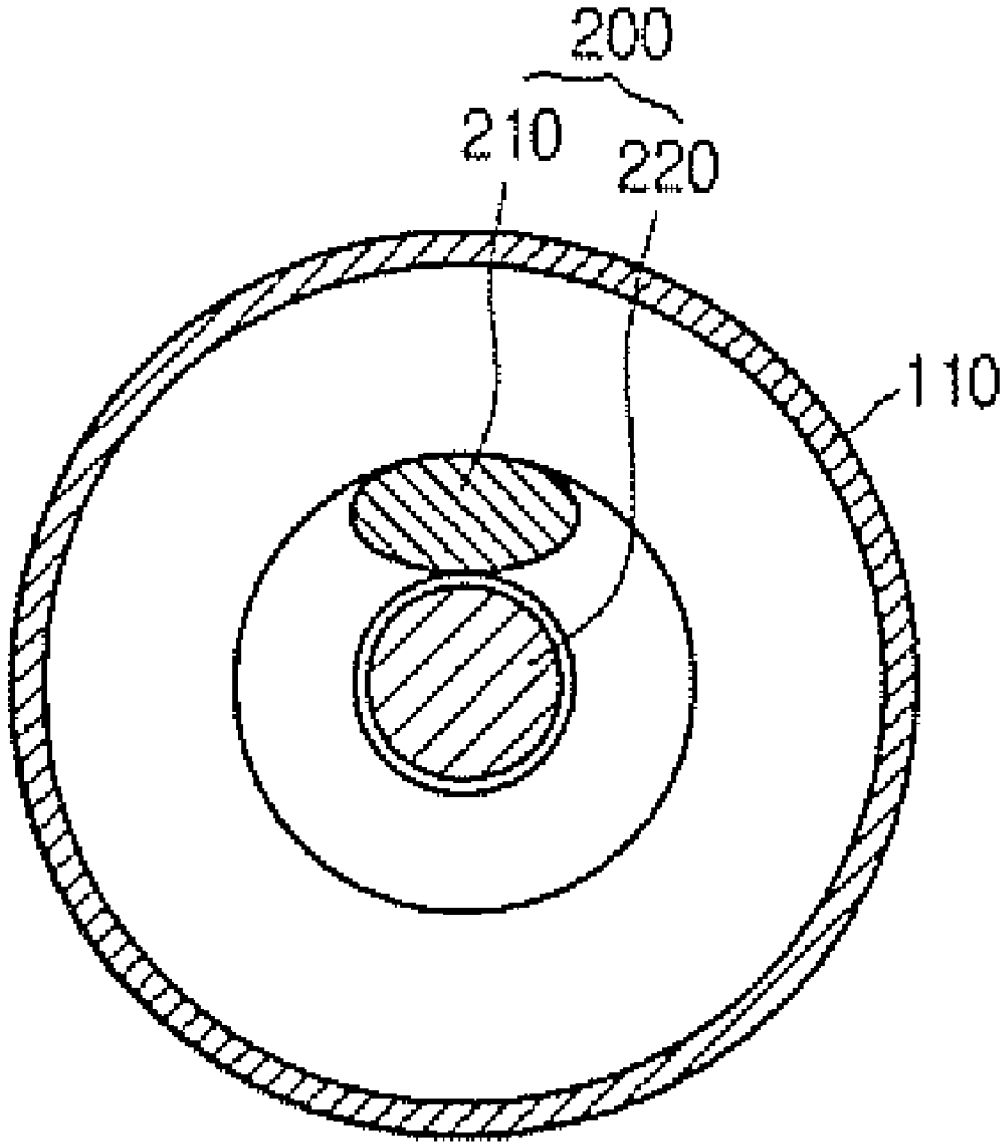

【 Figure 5】
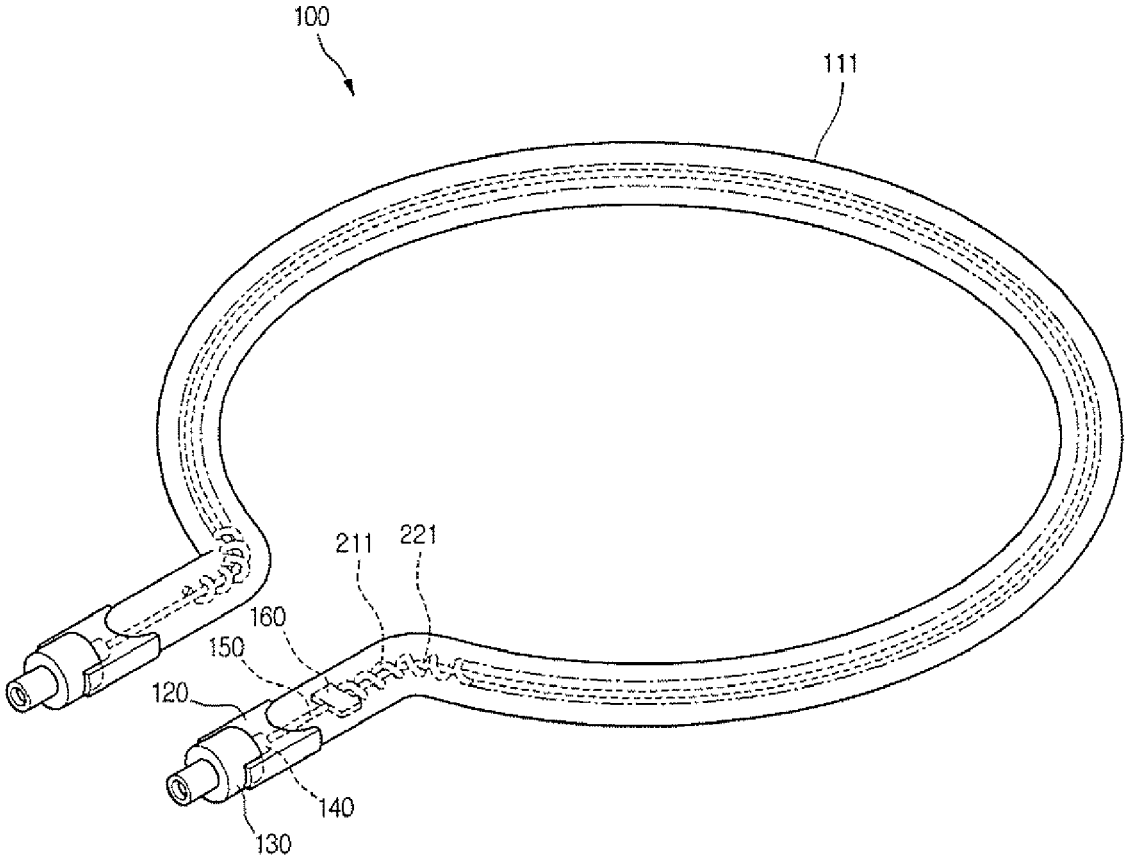

【 Figure 6】
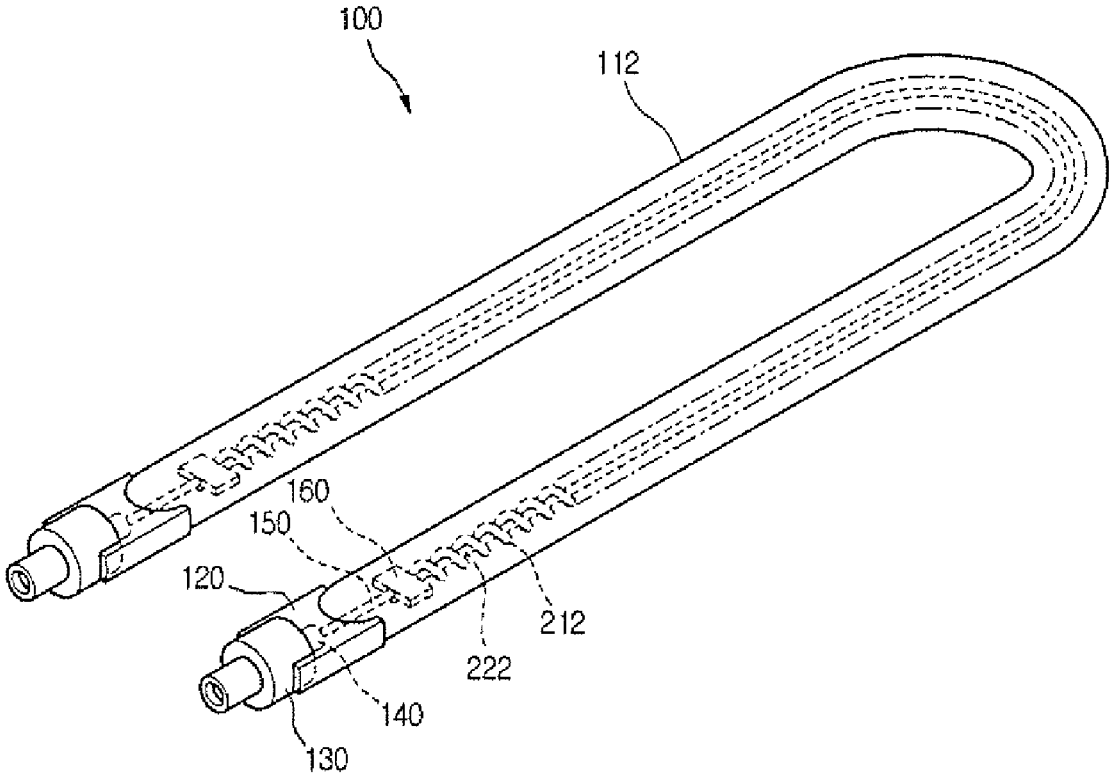

【 Figure 7】
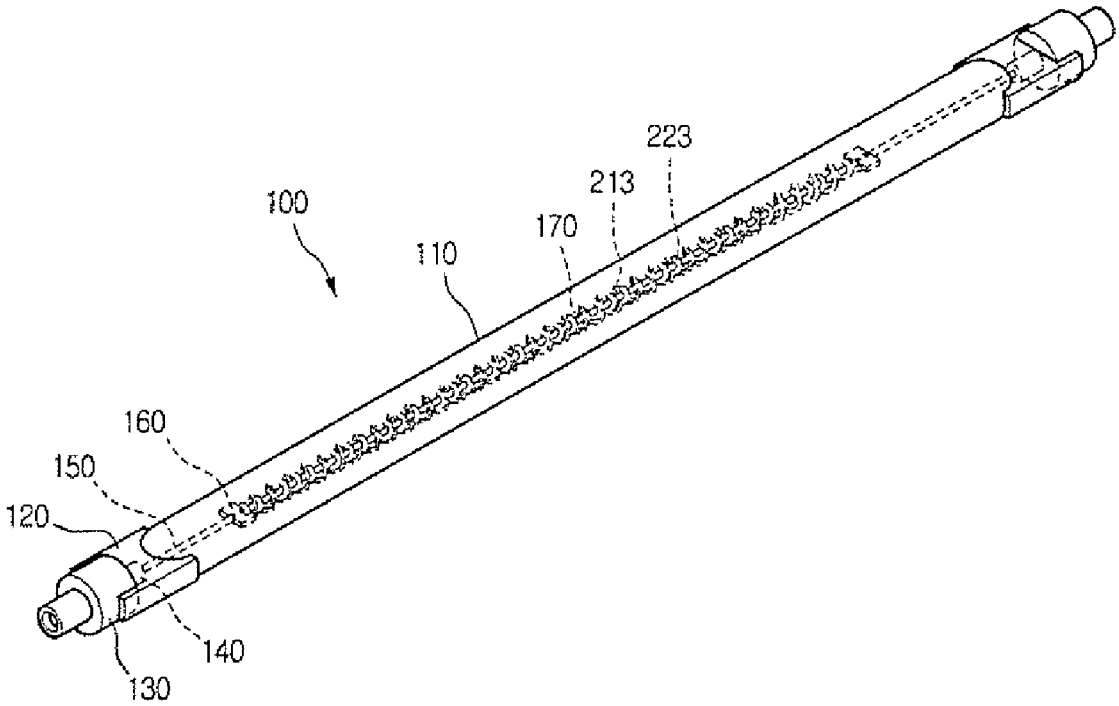

【 Figure 8】
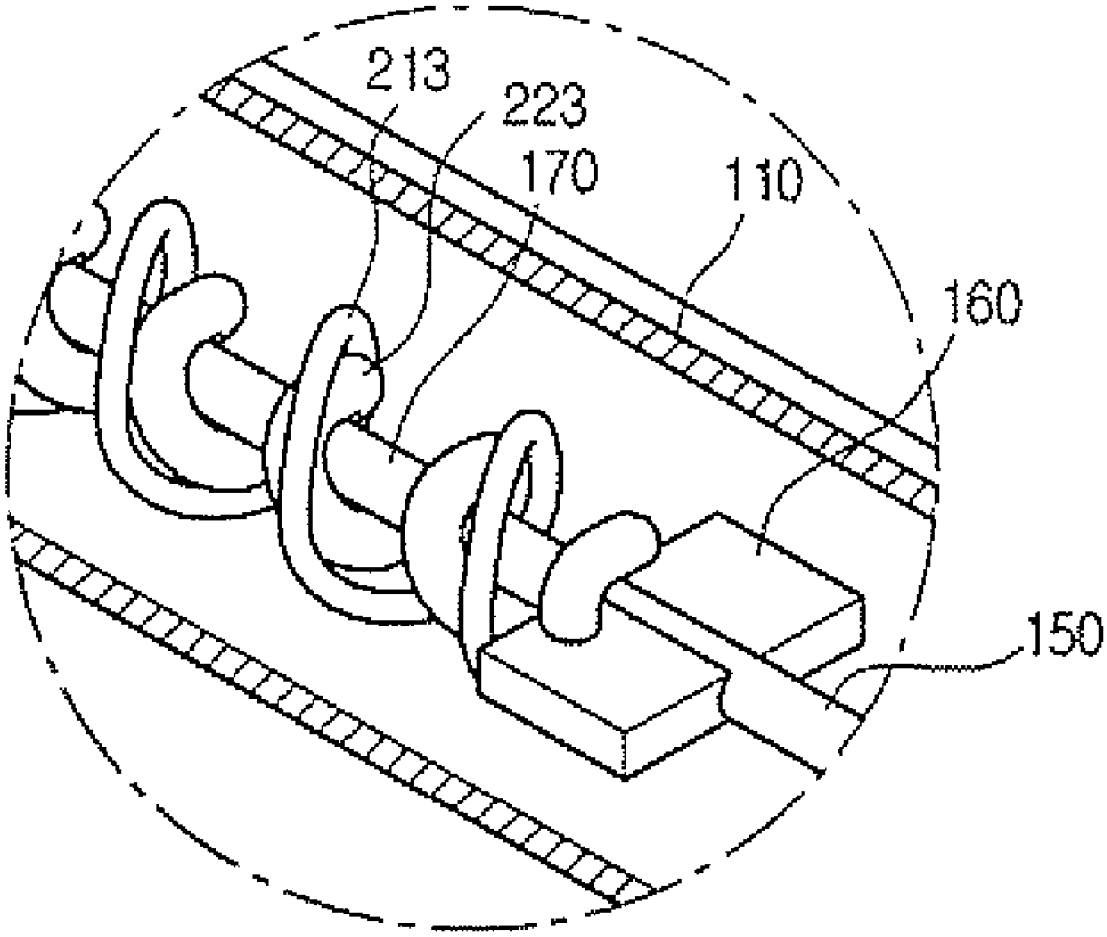

【Figure 9】
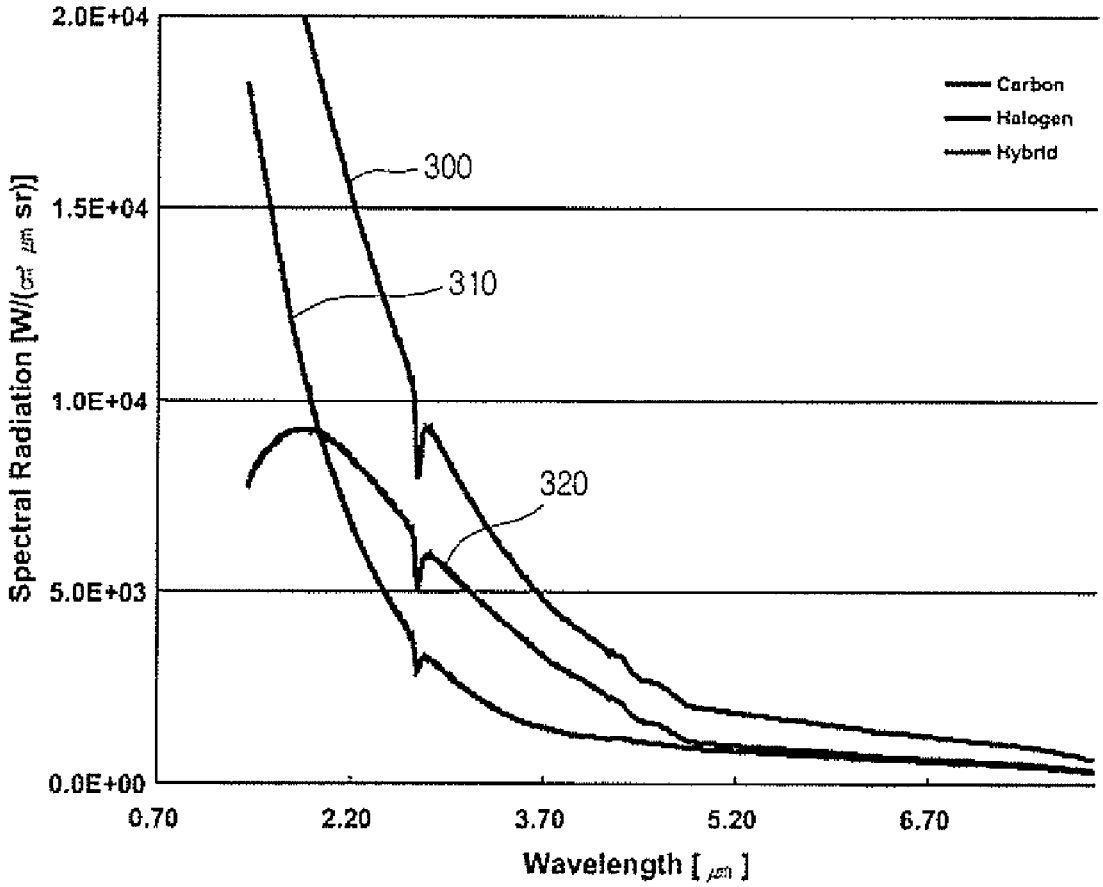

HEATING BODY

BACKGROUND OF THE INVENTION

1. Field of the Invention

The present invention relates to a heating body.

2. Description of the Related Art

Generally, a heating body includes a filament that is a heating part, a quartz tube into which the filament is inserted, and a connection part for connecting the filament to an external power source. The heating body converts an electric energy into a thermal energy to emit heat.

In detail, a filament formed of carbon is disposed at a center portion of the quartz tube, and the filament is connected to an external power source by the connection part, or the like. An inside of the quartz tube is vacuum or is filled with an inert gas such as a halogen gas. Therefore, when the carbon filament emits heat at a high temperature, an oxidation thereof is suppressed, which extends life of the heating body.

The carbon filament has a shape such as a spiral shape, a plate shape, a linear shape, or the like. A clip is used or a spring is employed for maintaining a tension in order to connect the carbon filament to an electrode. Using the above-mentioned methods, the carbon filament is disposed inside the quartz tube without contacting the quartz tube. The quartz tube melts or is damaged at more than approximately 800° C. Accordingly, when the carbon filament that is emitting heat contacts the quartz tube, the quartz tube is damaged, so that life of the heating body reduces. Therefore, as described above, the carbon filament is prevented from contacting the quartz tube using the clip or the spring.

However, in a related art heating body, the carbon filament is extended by external force and thus prevented from contacting the quartz tube. In such a structure, the carbon filament expands according to its thermal expansion coefficient when emitting heat at a high temperature. Therefore, the carbon filament further extends and eventually physically contacts the quartz tube, so that the quartz tube is damaged, which leads to reduction of life of the heating body.

SUMMARY OF THE INVENTION

Accordingly, the present invention is directed to a heating body that substantially obviates one or more problems due to limitations and disadvantages of the related art.

An object of the present invention is to provide a heating body that can reliably prevent a contact between a heating member and a tube surrounding the heating member.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a heating body including: a plurality of heating members having different thermal expansion coefficients respectively; and a tube in which the heating members are disposed. At least one of the plurality of heating members supports other heating member.

In another aspect of the present invention, there is provided a heating body including: a plurality of heating members having different thermal expansion coefficients respectively; and a tube in which the heating members are disposed. The plurality of heating members crosses one another at least once.

In a further another aspect of the present invention, there is provided a heating body including: a plurality of heating members having different thermal expansion coefficients respectively; a tube in which the heating members are disposed; and a supporting member supporting the heating member.

A heating body according to the present invention includes a plurality of heating members having different thermal expansion coefficients, and the heating members support one another. Therefore, although the heating member having a relatively high thermal expansion coefficient extends, the heating member may be supported by the heating member having a relatively low thermal expansion coefficient while emitting heat. Accordingly, since the heating member is prevented from contacting the tube, damage of the heating member and the tube due to a contact therebetween may be prevented, thereby extending life of the heating body.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings:

FIG. 1 is a perspective view of a heating body according to a first embodiment of the present invention;

FIG. 2 is a cross-sectional view taken along a line I-I' of the heating body of FIG. 1;

FIG. 3 is an enlarged view of section A of FIG. 3;

FIG. 4 is a cross-sectional view taken along a line II-II' of the heating body of FIG. 1;

FIG. 5 is a perspective view of a heating body according to a second embodiment of the present invention;

FIG. 6 is a perspective view of a heating body according to a third embodiment of the present invention;

FIG. 7 is a perspective view of a heating body according to a fourth embodiment of the present invention;

FIG. 8 is an enlarged view of section B of FIG. 7; and

FIG. 9 is a graph illustrating a simulation result of a related art heating body and a heating body according to the present invention.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

FIG. 1 is a perspective view of a heating body according to a first embodiment of the present invention.

Referring to FIG. 1, a heating body 100 according to the present invention includes a tube 110 having a reception space for internal elements and protecting the internal elements and a heating member 200 disposed in the tube 110 to emitting heat. Also, the heating body 100 includes a lead rod 150 supporting such that the heating member 200 does not contact the tube 110 and a connection part 160 connecting the lead rod 150 to the heating member 200. Also, the heating body 100 includes a metal piece 140 connected to other side of the lead rod 150 to electrically conducting between an external power source and the heating member 200, and an insulating part 130 insulating the metal piece 140 from the outside. In addition, the heating member 100 includes a sealing part 120 surrounding and supporting the metal piece 140, the insulating part 130, and the tube 110.

The tube 110 receives elements such as the heating member 200 therein and protects the elements. Since the heating body 100 emits heat at temperature of several hundred ° C., the tube 100 should be formed of a material having predetermined rigidity and thermal resistance. For example, the tube 100 may be a quartz tube. The tube 100 is hermetically sealed itself to isolate the heating member 200 from the outside. In the above-mentioned structure, an inert gas, or the like may be filled in the tube 100 to reduce damage of the heating member 200 due to emitting heat. Here, the tube 110 may be formed in a linear shape.

The heating member 200 emits heat by a conducted electric energy. In the present embodiment, the heating member 200 includes a first heating member 210 and a second heating member 220 which have different thermal expansion coefficients. The first and second heating members 210 and 220 support each other to prevent the heating member 200 contacting from the tube 110. This will be described later.

A plurality of connection parts 160 is connected to each of both ends of the heating member 200 to connect the heating member 200 to the lead rod 150. Therefore, the heating member 200 can extend to be connected to an external power source and emit heat without contacting the tube 110.

The lead rod 150 is connected to the heating member 200 by the connection part 160 to maintain an extension of the heating member 200. Therefore, the heating member 200 can stably emit heat without contacting the tube 100 even while emitting heat. A portion of the lead rod 150 extends to an outside of the tube 110. In the above-mentioned structure, while it is maintained that the tube 110 is hermitically sealed, the heating member 200 disposed therein can be connected to the external power source.

The metal piece 140 communicates with the external power source. The metal piece 140 is connected to the end of the lead rod 150 extending to the outside of the tube 110 to deliver an electric energy of the external power source to the heating member 200 through the led rod 150. Then, the heating member 200 receives the electric energy to emit heat.

The insulating part 130 insulates a portion of the metal piece 140 exposed outside to prevent an electric leakage from the metal piece 140. The insulating part 130 has a shape that can be inserted into a predetermined portion of an element so that the heating member 100 can be coupled to the element.

The sealing part 120 protects the end of the lead rod 150 extending to the outside of the tube 110 and a connecting portion of the metal piece 140 from the outside. Also, the sealing part 120 forms an assembly with the insulating part 130 and the tube 110 to support the heating body 100 such that the heating body 100 maintains a predetermined shape.

FIG. 2 is a cross-sectional view taken along a line I-I' of the heating body of FIG. 1.

Referring to FIG. 2, the heating body 100 according to the present embodiment includes the tube 110, the heating member 200 disposed in the tube 110, and the connection part 160, the lead rod 150, and the metal piece 140 which are sequentially connected to the heating member 200. The metal piece 140 is insulated by the insulating part 130, and the insulating part 130 and the tube 120 are surrounded and supported by the sealing part 120 to form a predetermined shape.

In the present embodiment, the heating member 200 includes the first heating member 210 having a predetermined thermal expansion coefficient and the second heating member 220 having a smaller thermal expansion coefficient than that of the first heating member 210. For this, the first heating member 210 may be formed of carbon, and the second heating member 220 may be formed of one of tungsten and a nickel/chrome-based alloy.

The first heating member 210 is supported by the second heating member 220. Therefore, although the first heating member 210 having a relatively high thermal expansion coefficient expands and droops while emitting heat while emitting heat, the second heating member 220 having a relatively low thermal expansion coefficient can support the first heating member 210. Accordingly, this can prevent the heating member 200 from contacting the tube 110 due to thermal expansion while emitting heat.

The first heating member 210 crosses the second heating member 220 at least once so that the second heating member 220 can support the first heating member 210. It is preferable that the first heating member 210 crosses the second heating member 220 a number of times so as to reliably support the first heating member 210.

In the present embodiment, the first and second heating members 210 and 220 having different thermal expansion coefficients, respectively, are illustrated, but the present invention is not limited thereto. That is, it will be understood that a plurality of heating members 200 having different thermal expansion coefficients, respectively, may be provided, and a heating member having a relatively high thermal expansion coefficient of the heating members 200, may be supported by a heating member having a relatively low thermal expansion coefficient, so that contact between the heating member 200 and the tube 110 is prevented.

FIG. 3 is an enlarged view of section A of FIG. 3.

Referring to FIG. 3, the first heating member 210 inserted into the tube 110 is connected to the lead rod 150 by the connection part 160. The second heating member 220 has a linear shape. The first heating member 210 is coiled around the second heating member 220 predetermined times. In the above-mentioned structure, the first heating member 210 can be supported by the second heating member 220. Therefore, although the first heating member 210 having a relatively high thermal expansion coefficient droops by thermal expansion while emitting heat, the first heating member 210 can be supported by the second heating member 220 having a relatively low thermal expansion coefficient. Accordingly, the heating member 200 can be prevented from contacting the tube 110 while emitting heat.

Except a method that the first heating member 210 is coiled around the second heating member 220 as described above, the second heating member 220 can support the first heating member 210 by various methods. For example, the first heating member 210 is adhered to the second heating member 220, and thus may be supported as described above.

FIG. 4 is a cross-sectional view taken along a line II-II' of the heating body of FIG. 1.

Referring to FIG. 4, in the heating member 200 disposed in the tube 100, the first heating member 210 is coiled around the second heating member 220. An outer surface of the first heating member 210 is spaced apart from an inner surface of the tube 110 by a predetermined distance, thereby preventing the heating member 200 from contacting the tube 110.

When the heating member 200 emits heat in this state, the first heating member 210 having a relatively high thermal expansion coefficient may droop. At this point, the first heating member 210 is supported by the second heating member 220, and thus the outer surface thereof can be prevented from contacting the tube 110.

Hereinafter, a heating member 100 according to another embodiment of the present invention will now be described. In the following descriptions, the same descriptions as those in the first embodiment of the present invention are omitted. Also, in each embodiment which follows, descriptions will be made for characteristics of each embodiment.

FIG. 5 is a perspective view of a heating body according to a second embodiment of the present invention.

Referring to FIG. 5, a heating body 100 according to the present embodiment includes a tube 111 having an omega (Ω) shape, and a first heating member 211 and a second heating member 221 which are inserted into the tube 111. The first heating member 211 is supported by the second heating member 221, and thus is prevented from contacting the tube 111.

In detail, the first heating member 211 is coiled around the second heating member 221. Therefore, a supporting force of the second heating member 221 is delivered to the first heating member 211, thereby maintaining the state where the first heating member 211 is spaced apart from the tube 111 by a predetermined interval while even emitting heat. Accordingly, the first and second heating members 211 and 221 can be prevented from contacting the tube 111.

FIG. 6 is a perspective view of a heating body according to a third embodiment of the present invention.

Referring to FIG. 6, a heating body 100 according to the present embodiment includes a tube 112 having a "U" shape and a first heating member 212 and a second heating member 222 which are inserted into the tube 112. The first heating member 212 is supported by the second heating member 222, and thus is prevented from contacting the tube 112.

In detail, the first heating member 212 is coiled around the second heating member 222. Therefore, a supporting force of the second heating member 222 is delivered to the first heating member 212, thereby maintaining the state where the first heating member 212 is spaced apart from the tube 112 by a predetermined interval even while emitting heat. Accordingly, the first and second heating members 212 and 222 can be prevented from contacting the tube 112.

In the above-mentioned embodiments, the heating body using the various shapes of tube is illustrated, but the present invention is not limited thereto. That is, various shapes of tube can be used as well as the tube of the shapes illustrated in the embodiments, and various embodiments can be proposed where the heating members having different thermal expansion coefficients, respectively, support one another inside the tube.

FIG. 7 is a perspective view of a heating body according to a fourth embodiment of the present invention. FIG. 8 is an enlarged view of section B of FIG. 7.

Referring to FIGS. 7 and 8, a heating body 100 according to the present embodiment includes a tube 110 and a heating member 200 inserted into the tube 110. The hating member 200 includes a first heating member 212 having a relatively high thermal expansion coefficient and a second heating member 223 having a relatively low thermal expansion coefficient.

In the present embodiment, the first and second heating members 213 and 223 are coiled predetermined times. At this point, the first heating member 213 is disposed at an outside of the second heating member 223. That is, the second heating member 223 is coiled predetermined times, and the first heating member 213 is coiled to surround the outside of the second heating member 223 predetermined times. A heating amount of the first and second heating members 213 and 223 can be increased by such a structure. Also, the first heating member 213 is supported by the second heating member 223, thereby preventing the first and second heating members 213 and 223 from contacting the tube 110 while emitting heat.

Meanwhile, as illustrated in FIGS. 7 and 8, a supporting member 170 may be disposed in the second heating member 223. The supporting member 170 may be connected to a lead rod 150 by a connection part 160 to have a predetermined supporting force. Therefore, the first and second heating members 213 and 223 can be supported by the supporting force, thereby preventing more reliably the heating members 213 and 223 from contacting the tube 110.

The second heating member 223 having a relatively low thermal expansion coefficient is disposed closer than the first heating member 213 having a relatively high thermal expansion coefficient to the supporting member 170. Therefore, the first heating member 213 can be supported by the second heating member 223 and the supporting member 170 simultaneously.

FIG. 9 is a graph illustrating a simulation result of a related art heating body and a heating body according to the present invention.

Referring to FIG. 9, reference numerals 310, 320 and 330 respectively represent simulation results of a related art heating body using halogen, a related art heating body using a heating member formed of carbon, and the heating member 100 according to the present invention.

As illustrated in FIG. 9, an energy density of the heating body 100 according to the present invention covers portions of high energy densities shown in the results 310 and 320 of the related art heating bodies. Therefore, the heating body 100 of the present invention can emit heat at a high energy density over a large range of wavelength band.

The heating body according to the present invention includes a plurality of heating members having different thermal expansion coefficients, and the heating members support one another. Therefore, although the heating member having a relatively high thermal expansion coefficient droops, the heating member can be supported by the heating member having a relatively low thermal expansion coefficient while emitting heat. Accordingly, since the heating member is prevented from contacting the tube, damage of the heating member and the tube due to a contact thereof can be prevented, thereby extending life of the heating body.

According to the heating body, a plurality of heating members having different thermal expansion coefficients is disposed and supported by each other in the tube of a linear shape, an omega shape, a "U" shape, or the like. Therefore, the heating member is prevented from contacting the tube, and the tube of various shapes can be used for the heating body.

Also, according to the heating body, since the heating member is formed of a coiled shape, or the like, a heating amount can be increased without enlarging the size of the heating body. Accordingly, while the heating body is fabricated in a compact size, a heating amount thereof can be increased.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A heating body comprising:

a lead rod that conducts electricity from an external power source;

a supporting member connected to the lead rod, the supporting member having a predetermined supporting force;

a plurality of heaters, each coiled around the supporting member, having different thermal expansion coefficients, respectively, the plurality of heaters including first and second heating members, the first heating member disposed at an outside of the second heating member, the second heating member disposed around the supporting member such that the second heating member is disposed closer to the supporting member than the first heating member, the first heating member having a relatively higher thermal expansion coefficient than the second heating member; and a tube in which the heaters are disposed, wherein at least one of the plurality of heaters supports at least one other heater, wherein the tube is formed in a hollow shape, and the heaters are spaced apart from an innermost internal side of the tube to form an empty space between an external side of the plurality of heaters and the innermost internal side of the tube.

2. The heating body according to claim 1, wherein the plurality of heaters crosses one another.

3. The heating body according to claim 1, wherein at least one of the plurality of heaters has a straight line shape.

4. The heating body according to claim 3, wherein the straight line-shaped heater supports at least one other heater.

5. The heating body according to claim 1, wherein at least one of the plurality of heaters is coiled a predetermined number of times.

6. The heating body according to claim 1, wherein each of the plurality of heaters is coiled a predetermined number of times.

7. The heating body according to claim 1, wherein the plurality of heaters are adhered to one another.

8. The heating body according to claim 1, wherein one of the plurality of heaters is formed of carbon, and at least one other heater is formed of one of tungsten and a nickel/chrome-based alloy.

9. The heating body according to claim 1, wherein the tube has one of a linear shape, an omega (Ω) shape, and a "U" shape.

10. The heating body according to claim 1, wherein each of the first and second heating members are coiled in the same direction around the supporting member.

11. A heating body comprising:

a lead rod that conducts from an external power source;

a supporting member connected to the lead rod, the supporting member having a predetermined supporting force;

a plurality of heaters having different thermal expansion coefficients, respectively, wherein the first heating member is coiled around the supporting member such that an inside coiled surface of the first heating member is spaced apart from an outside surface of the supporting member, and wherein the second heating member is coiled around the supporting member and an outside coiled surface of the second member has a diameter less than a diameter of the inside coiled surface of the first heating member; and a tube in which the heaters are disposed, wherein the tube is formed in a hollow shape, and the heaters are spaced apart from an innermost internal side of the tube to form an empty space between an external side of the plurality of heaters and the innermost internal side of the tube.

12. The heating body according to claim 11, wherein one of the plurality of heaters is coiled to surround an outside of at least one other heater.

13. The heating body according to claim 11, wherein the plurality of heaters cross one another at least once, and one of the crossing heaters supports at least one other crossed heater.

14. The heating body according to claim 11, wherein the plurality of heaters cross one another at least once, and the plurality of heaters are adhered to one another.

15. The heating body according to claim 11, wherein each of the plurality of heaters is coiled a predetermined number of times.

16. The heating body according to claim 11, wherein each of the first and second heating members are coiled in the same direction around the supporting member.

17. A heating body comprising:

a lead rod that conducts from an external power source;

a supporter connected to the lead rod, the supporter having a predetermined supporting force;

a plurality of heaters having different thermal expansion coefficients, respectively, the plurality of heaters including first and second heating members, the first heating member disposed at an outside of the second heating member, the second heating member disposed around the supporter such that the second heating member is disposed closer to the supporter than the first heating member, the first heating member having a relatively higher thermal expansion coefficient than the second heating member; and a tube in which the heaters are disposed;

wherein the supporter supports at least one heater, wherein the tube is formed in a hollow shape, and the heaters are spaced apart from an innermost internal side of the tube to form an empty space between an external side of the plurality of heaters and the innermost internal side of the tube.

18. The heating body according to claim 17, wherein the heater is coiled to surround the supporter.

19. The heating body according to claim 17, wherein each of the first and second heating members are coiled in the same direction around the supporter.

* * * * *